US012121080B2

(12) United States Patent
Anderson et al.

(10) Patent No.: US 12,121,080 B2
(45) Date of Patent: Oct. 22, 2024

(54) WAISTBAND FOR A GARMENT

(71) Applicant: LULULEMON ATHLETICA CANADA INC., Vancouver (CA)

(72) Inventors: Linn Anderson, Vancouver (CA); Yurika Cherise Shikai, Vancouver (CA); Allison Morgan Taylor, Vancouver (CA)

(73) Assignee: LULULEMON ATHLETICA CANADA INC., Vancouver (CA)

( * ) Notice: Subject to any disclaimer, the term of this patent is extended or adjusted under 35 U.S.C. 154(b) by 96 days.

(21) Appl. No.: 18/158,946

(22) Filed: Jan. 24, 2023

(65) Prior Publication Data

US 2023/0240385 A1 Aug. 3, 2023

Related U.S. Application Data

(60) Provisional application No. 63/304,525, filed on Jan. 28, 2022.

(51) Int. Cl.
*A41F 9/00* (2006.01)
*A41D 1/06* (2006.01)

(52) U.S. Cl.
CPC . *A41D 1/06* (2013.01); *A41F 9/00* (2013.01)

(58) Field of Classification Search
CPC . A41D 1/06; A41D 1/089; A41D 1/08; A41D 1/21; A41F 9/00; A41F 9/02; A41F 9/025
See application file for complete search history.

(56) References Cited

U.S. PATENT DOCUMENTS

| | | | | |
|---|---|---|---|---|
| 3,590,823 | A * | 7/1971 | Pope, Jr. | A41F 11/18 450/95 |
| 6,023,789 | A * | 2/2000 | Wilson | A41D 1/089 2/404 |
| 9,427,029 | B2 * | 8/2016 | Castellano | A41B 17/00 |
| 10,806,190 | B1 * | 10/2020 | Kardashian West | A41C 1/003 |
| 11,925,218 | B1 * | 3/2024 | Xu | A41D 1/06 |
| 2018/0263299 | A1 * | 9/2018 | Padin | A41C 1/003 |
| 2019/0174836 | A1 * | 6/2019 | DeBusk | A41D 1/06 |
| 2020/0260805 | A1 * | 8/2020 | Ovington | A41D 17/02 |
| 2022/0264968 | A1 * | 8/2022 | Bentz | A41D 1/06 |
| 2023/0218026 | A1 * | 7/2023 | Todaro | A41D 1/21 2/79 |
| 2023/0276879 | A1 * | 9/2023 | Lazic | A41F 9/00 2/69 |

FOREIGN PATENT DOCUMENTS

| | | | | |
|---|---|---|---|---|
| CA | 3190127 | A1 * | 1/2024 | A41B 9/004 |
| WO | WO-2022223585 | A1 * | 10/2022 | A41B 11/003 |

* cited by examiner

*Primary Examiner* — Tajash D Patel

(57) ABSTRACT

Examples of a waistband for a garment are disclosed. The waist band includes a front portion for covering at least a portion of an abdomen of a wearer, a back portion for covering at least a portion of a lower back area of the wearer, a first inner panel extending from a front central line at the front portion to a back central line at the back portion, a second inner panel extending from the front central line at the front portion to the back central line at the back portion, and at least one bonding adhesive panel bonding together the back portion with the first and second inner panels. The inside of the disclosed waistbands are seamless.

21 Claims, 12 Drawing Sheets

WAISTBAND FOR A GARMENT

TECHNICAL FIELD

The present disclosure relates to a waistband for a garment.

BACKGROUND

Waistbands are included as part of many clothing garments to encircle the waist of a wearer and to hold the garment in place against the wearer. Examples of current waistbands include drawstrings, elastic bands, and fabric bands with varying elasticities and/or stiffness. While there are various types of known waistbands for garments, there are some limitations and disadvantages associated therewith.

For example, many existing waistbands can be felt as either too loose or too tight to the wearer, may roll-over or buckle (particularly during exercise), are rough against the wearer's skin, or create a visual distraction.

Thus, there remains a need for waistbands that allow the garment to be easy to pull on and pull off, that are smooth against the wearer's body, and are visually non-distracting to the wearer.

SUMMARY OF THE APPLICATION

In various embodiments, the present disclosure provides three-layer waistbands for a clothing garment that are seamless and allow the garment to be pulled on and off easily by a wearer.

In one aspect, the present disclosure provides a waistband for a garment, comprising: a front portion for covering at least a portion of an abdomen area of a wearer, the front portion having a front portion outer panel extending from a first side of the front portion to a second side of the front portion, the front portion outer panel having a front portion inner face and a front portion outer face; a back portion for covering at least a portion of a lower back area of the wearer, the back portion having a back portion outer panel extending from a first side of the back portion to a second side of the back portion, the back portion outer panel having a back portion inner face and a back portion outer face, the first side of the back portion connected to the second side of the front portion forming a first side seam, the second side of the back portion connected to the first side of the front portion forming a second side seam, and the front portion outer face and the back portion outer face forming an outside of the waistband; a first inner panel having a first inner panel front side, a first inner panel back side, a first inner panel inner face and a first inner panel outer face, the first inner panel extending from a front central line at the front portion to a back central line at the back portion and covering the first side seam; a second inner panel having a second inner panel front side, a second inner panel back side, a second inner panel inner face and a second inner panel outer face, the second inner panel extending from the front central line at the front portion to the back central line at the back portion and covering the second side seam, the first inner panel outer face and the second inner panel outer face forming an inside of the waistband; and at least one bonding adhesive panel bonding together the back portion outer panel with the first and the second inner panels, wherein an inside of the waistband is seamless.

In various embodiments, the at least one bonding adhesive panel also bonds together the front portion outer panel with the first and the second inner panels. For example, the first inner panel front side may be bonded to and overlapping the second inner panel front side, and/or the first inner panel back side may be bonded to and overlapping the second inner panel back side.

In various embodiments, the waistband further comprises at least one pocket bag connected to a top edge of the front portion, at least a portion of the at least one pocket bag being bonded to at least one of the first inner panel inner face and/or the second inner panel inner face such that the at least one pocket bag is facing the front portion inner face of the front portion outer panel, the at least one pocket bag having an entrance opening to access into the packet bag and the front portion having a corresponding opening. In various embodiments, the at least one pocket bag is separate from the outer panel inner face. For example, a lower part of the at least one pocket bag is free hanging from a lower edge of the first inner panel and/or the second inner panel. In various embodiments, the at least one pocket bag is connected to one of the first or the second side seams. In various embodiments, one pocket bag is bonded to the first inner panel front side and an additional pocket bag is bonded to the second inner panel front side. In various embodiments, the waistband further comprises a fastener configured to close and open the entrance opening of the at least one pocket bag.

In various embodiments, the at least one bonding adhesive panel is engineered to form an adhesive pattern. For example, the adhesive pattern may be configured to form at least two zones, one zone having a first stretching value and the second zone having a second stretching value, the second stretching value being different from the first stretching value.

In various embodiments, the waistband further comprises an elastic band along a top edge of the waistband.

In various embodiments, the garment may be a pair of pants, a pair of tights, a pair of shorts, a skirt, a skort or a dress.

In another aspect, the present disclosure provides a waistband for a garment, comprising: a front portion for covering at least a portion of an abdomen area of a wearer, the front portion having a front portion outer panel extending from a first side of the front portion to a second side of the front portion, the front portion outer panel having a front portion inner face and a front portion outer face; a back portion for covering at least a portion of a lower back area of the wearer, the back portion having a back portion outer panel extending from a first side of the back portion to a second side of the back portion, the back portion outer panel having a back portion inner face and a back portion outer face, the first side of the back portion connected to the second side of the front portion forming a first side seam, the second side of the back portion connected to the first side of the front portion forming a second side seam, and the front portion outer face and the back portion outer face forming an outside of the waistband; a first inner panel having a first inner panel front side, a first inner panel back side, a first inner panel inner face and a first inner panel outer face; a second inner panel having a second inner panel front side, a second inner panel back side, a second inner panel inner face and a second inner panel outer face, the first inner panel outer face and the second inner panel outer face forming an inside of the waistband; at least one pocket bag connected to a top edge of the front portion, at least a portion of the at least one pocket bag being bonded to at least one of the first inner panel inner face and/or the second inner panel inner face such that the at least one pocket bag is facing the front portion inner face of the front portion outer panel, the at least one pocket bag having an entrance opening to access into the pocket bag and the front portion having a corresponding opening, the at least one pocket bag being separate from the outer panel inner face; and at least one bonding adhesive panel to bond the at least one of the first inner panel inner face and/or the second inner panel inner face with the at least one pocket bag and the back portion outer panel with at least one of the first and the second inner panels, wherein the inside of the waistband is seamless.

In various embodiments, a lower part of the at least one pocket bag is free hanging from a lower edge of at least one of the first inner panel and/or the second inner panel.

In various embodiments, the at least one pocket bag is connected to one of the first or the second side seams.

In various embodiments, one pocket bag is bonded to the first inner panel front side and an additional pocket bag is bonded to the second inner panel front side.

In various embodiments, the at least one bonding adhesive panel is engineered to form an adhesive pattern. For example, the adhesive pattern may be configured to form at least two zones, one zone having a first stretching value and the second zone having a second stretching value, the second stretching value being different from the first stretching value.

In a further aspect, the present disclosure provides a waistband for a garment, comprising: a front portion for covering at least a portion of an abdomen area of a wearer, the front portion having a front portion outer panel extending from a first side of the front portion to a second side of the front portion, the front portion outer panel having a front portion inner face and a front portion outer face, a back portion for covering at least a portion of a lower back area of the wearer, the back portion having a back portion outer panel extending from a first side of the back portion to a second side of the back portion, the back portion outer panel having a back portion inner face and a back portion outer face, the first side of the back portion connected to the second side of the front portion forming a first side seam, the second side of the back portion connected to the first side of the front portion forming a second side seam, and the front portion outer face and the back portion outer face forming an outside of the waistband; a first inner panel having a first inner panel front side, a first inner panel back side, a first inner panel inner face and a first inner panel outer face; a second inner panel having a second inner panel front side, a second inner panel back side, a second inner panel inner face and a second inner panel outer face, the first inner panel outer face and the second inner panel outer face forming an inside of the waistband; and at least one bonding adhesive panel to bond the at least one of the first inner panel inner face and/or the second inner panel inner face with the at least one of the outer panels, wherein the at least one bonding adhesive panel is engineered to form an adhesive pattern, the adhesive pattern configured to form at least two zones, one zone having a first stretching value and the second zone having a second stretching value, the second stretching value being different from the first stretching value, and wherein the inside of the waistband is seamless.

In addition to the aspects and embodiments described above, further aspects and embodiments will become apparent by reference to the drawings and study of the following detailed description.

BRIEF DESCRIPTION OF THE DRAWINGS

Throughout the drawings, reference numbers may be re-used to indicate correspondence between referenced elements. The drawings are provided to illustrate example embodiments described herein and are not intended to limit the scope of the application. Sizes and relative positions of elements in the drawings are not necessarily drawn to scale. For example, the shapes of various elements and angles may be not drawn to scale, and some of these elements may be arbitrarily enlarged and positioned to improve drawing legibility.

In the accompanying drawings, which illustrate one or more exemplary embodiments.

DETAILED DESCRIPTION

In the following description, details are set forth to provide an understanding of the application. In some instances, certain structures, techniques, and methods have not been described or shown in detail in order not to obscure the application.

In the context of the present disclosure, various terms are used in accordance with what is understood to be the ordinary meaning of those terms.

Directional terms such as "top", "bottom", "front", "back", "upper", "lower", "outer" and "inner" are used in the following description for the purpose of providing relative reference only, and are not intended to suggest any limitations on how any article or garment is to be positioned during use, or to be mounted in an assembly or relative to an environment. The use of the word "a" or "an" when used herein in conjunction with the term "comprising" may mean "one", but it is also consistent with the meaning of "one or more", "at least one" and "one or more than one". Any element expressed in the singular form also encompasses its plural form. Any element expressed in the plural form also encompasses its singular form. The term "plurality" as used herein means more than one, for example, two or more, three or more, four or more, and the like.

The present disclosure relates to a waistband for a garment. In various embodiments, the disclosure provides waistbands that are easy for a wearer to pull on and pull off, minimize visual distraction, and have a seamless interior, so as to provide enhanced comfort to the wearer.

In the context of the present disclosure, the term "seamless" defines a fabric surface that is smooth, and without seams or obvious joins between one part or section and the next.

Figure 1:
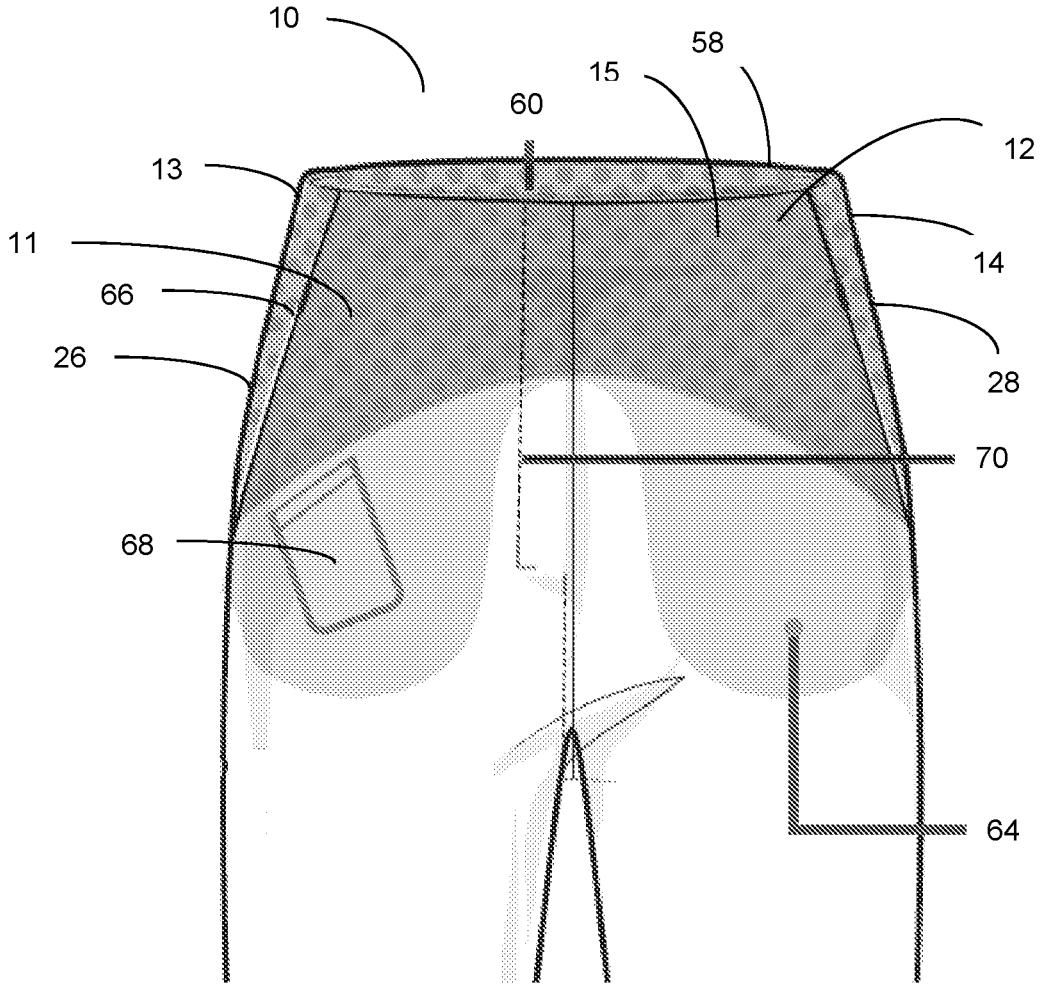
FIG. 1 is a front plan view of a waistband for a garment in accordance with an embodiment of the invention.
Figure 3:
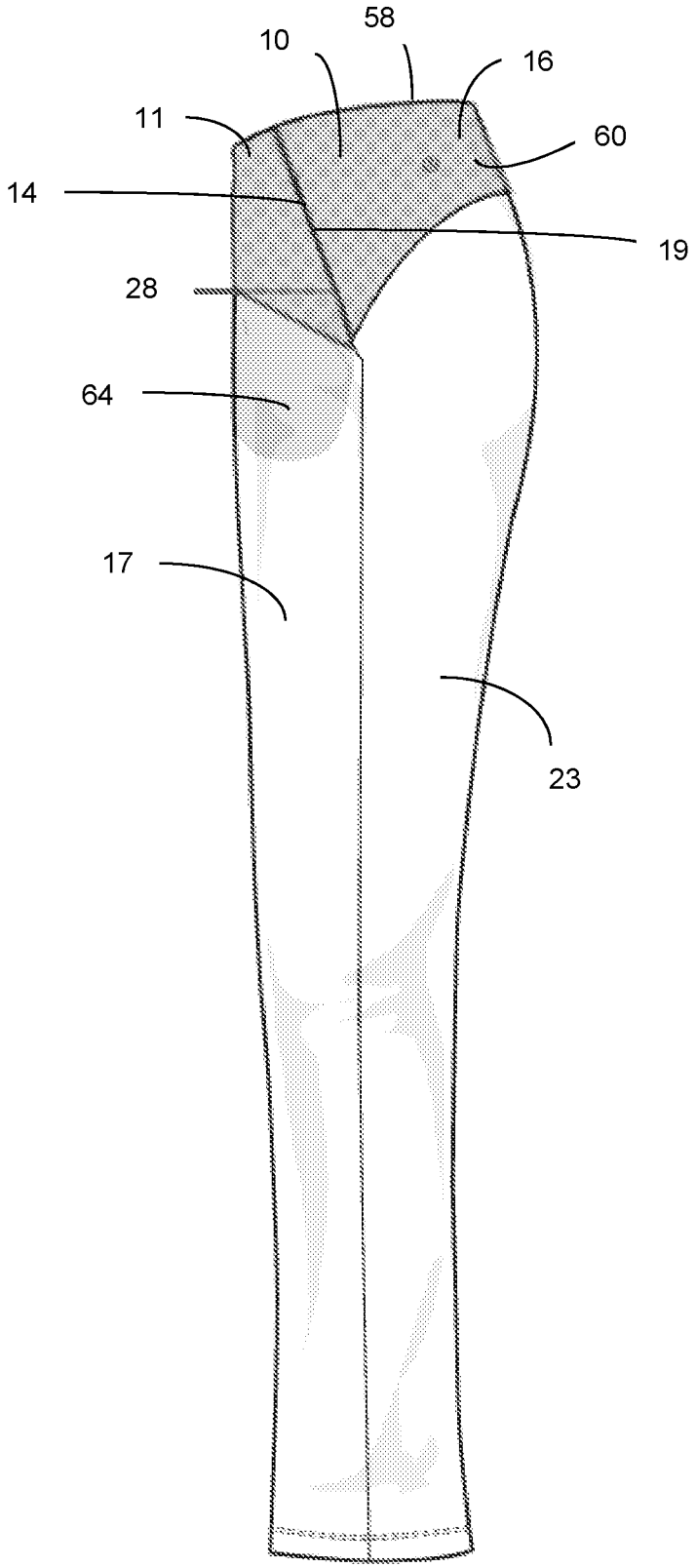
FIG. 3 is a side plan view of a waistband for a garment in accordance with an embodiment of the invention.
Figure 4:
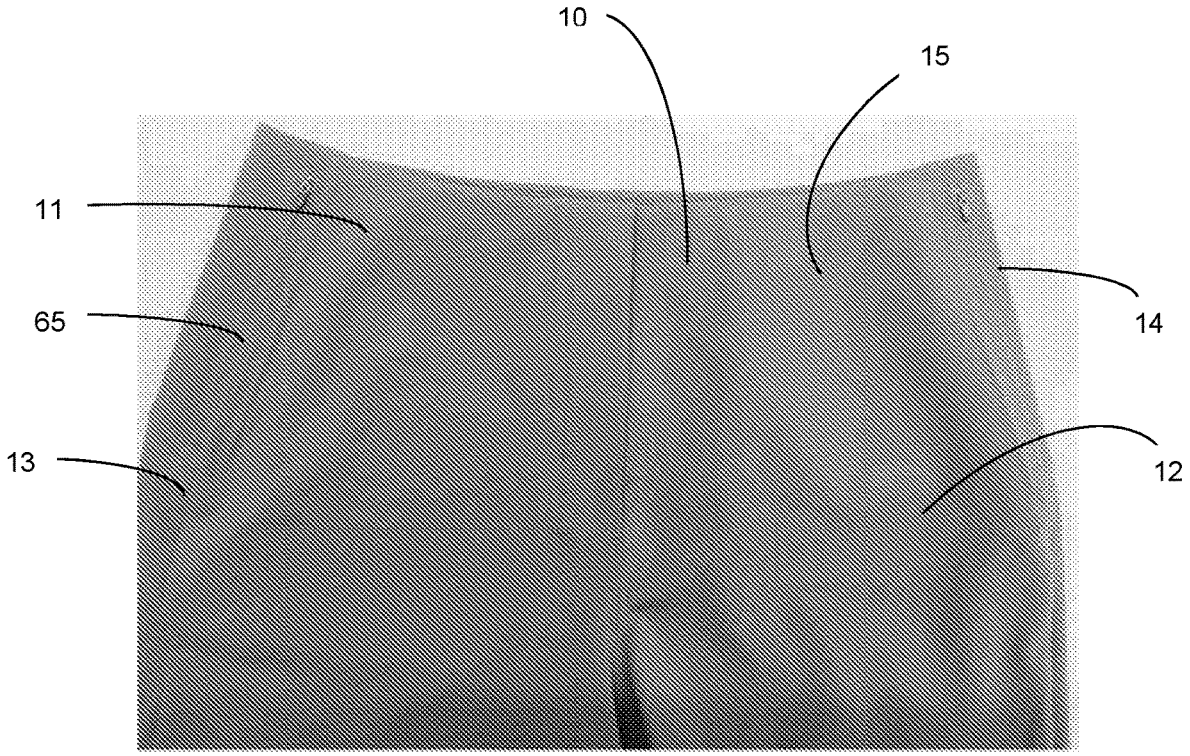
FIG. 4 is a photograph of a front view of an exterior of a waistband for a garment in accordance with an embodiment of the invention.
Figure 6:
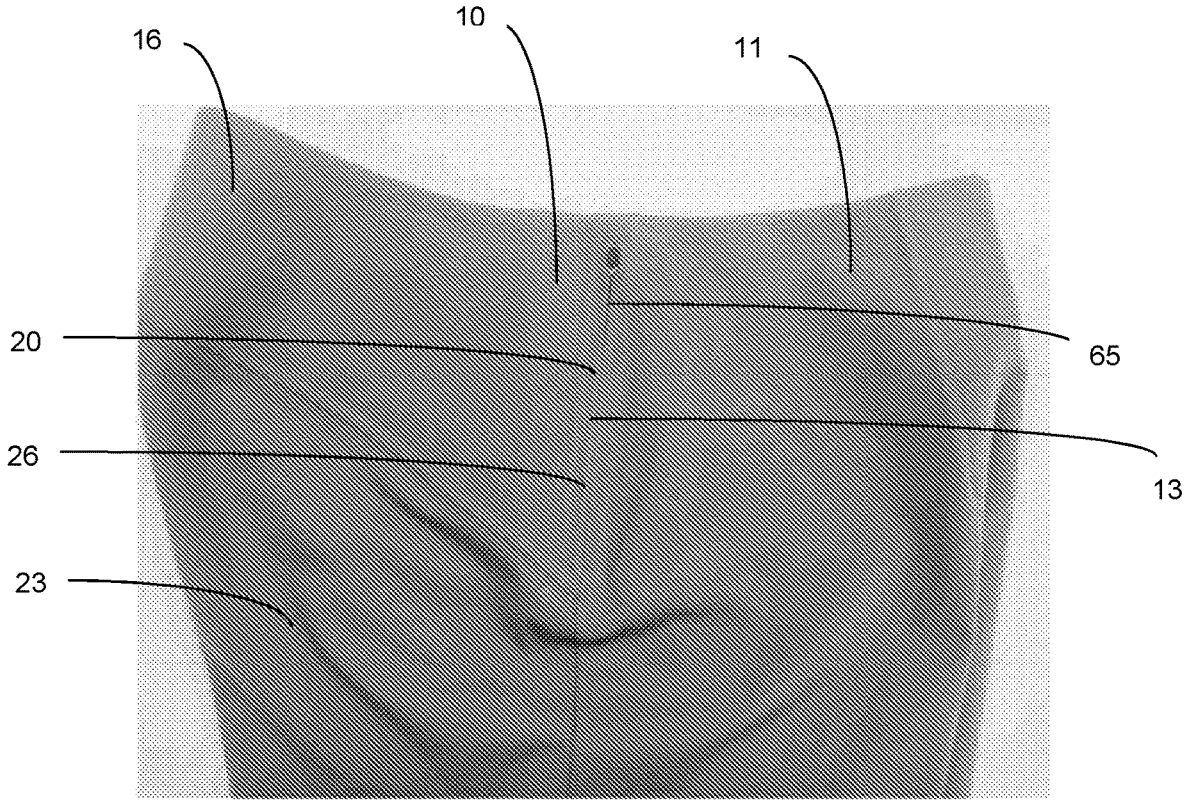
FIG. 6 is a photograph of a side view of an exterior of a waistband for a garment in accordance with an embodiment of the invention.

Referring to FIGS. 1 and 4, and according to a first embodiment of the invention, a waistband 10 for a garment is shown. The waistband 10 comprises a front portion 11 for covering at least a portion of an abdomen area of a wearer. The front portion 11 has a front portion outer panel 12 extending from a first side 13 of the front portion 11 to a second side 14 of the front portion 11. The front portion outer panel 12 has a front portion inner face (not shown) and a front portion outer face 15. In various embodiments, the front portion outer panel 12 may include the front portion of the garment itself, such as, for example, the front portion of a pair of pants as shown in FIGS. 4 and 6 which extends from the first side 13 to the second side 14, and from a top to a bottom of the garment. Alternatively, the front portion outer panel 12 may be connected to a further front panel 17 so as to form a front portion of garment, as shown in FIG. 3.

Figure 2:
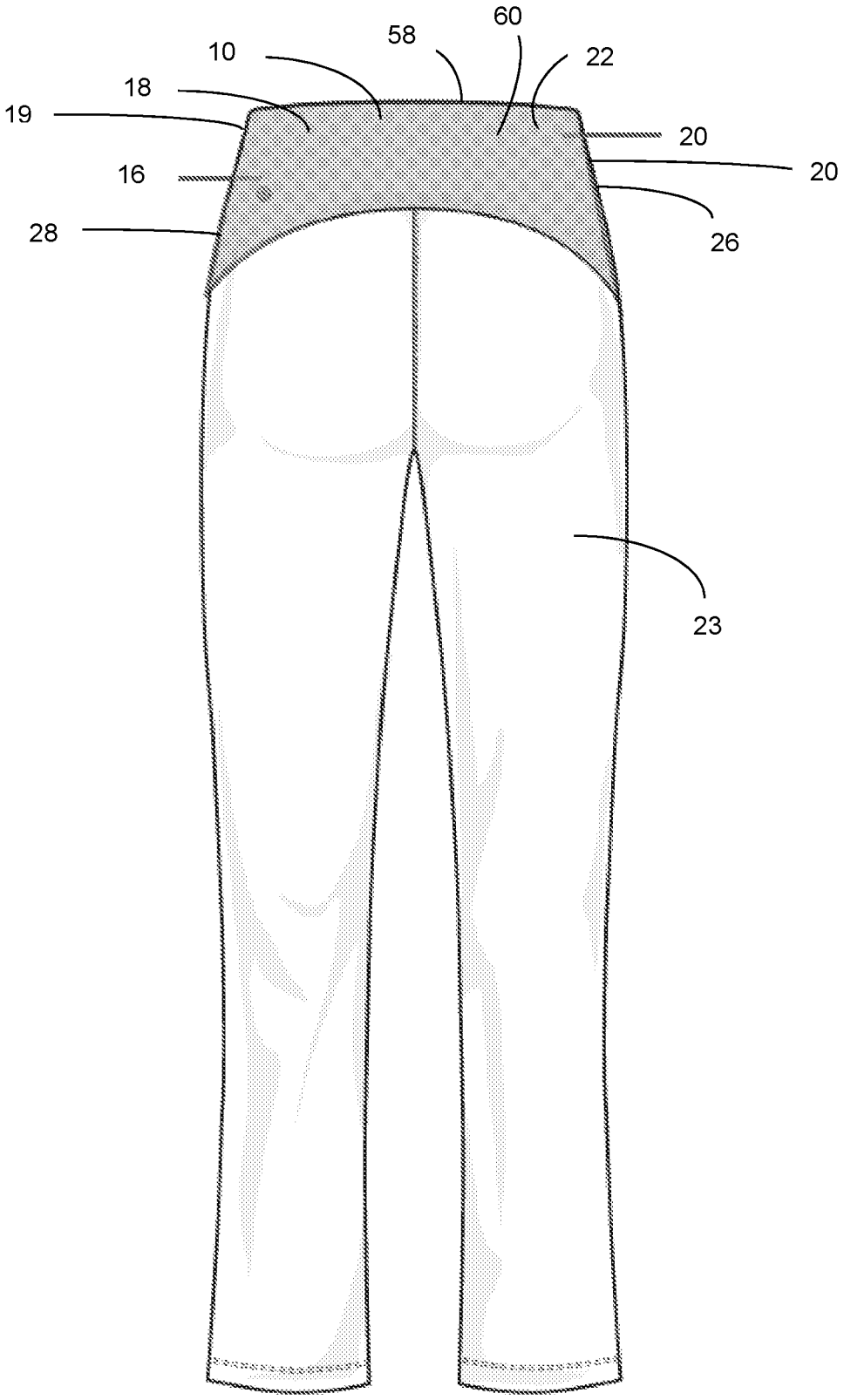
FIG. 2 is a back plan view of a waistband for a garment in accordance with an embodiment of the invention.
Figure 5:
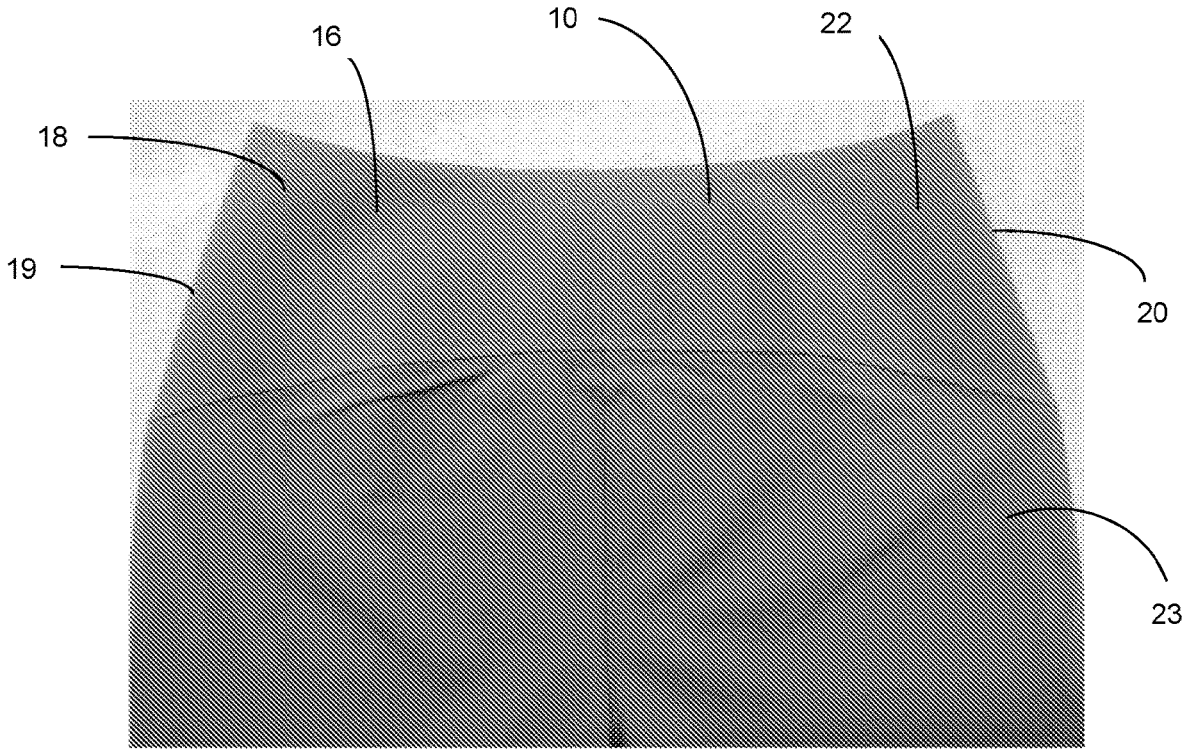
FIG. 5 is a photograph of a back view of an exterior of a waistband for a garment in accordance with an embodiment of the invention.

The waistband 10 also includes a back portion 16 for covering at least a portion of a lower back area of the wearer as shown in FIGS. 2 and 5, the back portion 16 having a back portion outer panel 18 extending from a first side 19 of the back portion 16 to a second side 20 of the back portion 16, the back portion outer panel 18 having a back portion inner face (not shown) and a back portion outer face 22. In various embodiments, the back portion 16 is connected to a further back panel 23 so as to form a back portion of the garment, as shown in FIG. 2. Alternatively, the back portion outer panel 18 may form the back portion of the garment.

The first side 13 of the front portion 11 is connected to the second side 20 of the back portion 16 to form a first side seam 26 of the waistband 10 (FIG. 6), and the second side 14 of the front portion 11 is connected to the first side 19 of the back portion 16 to form a second side seam 28 of the waistband 10 (FIG. 3).

Figure 7:
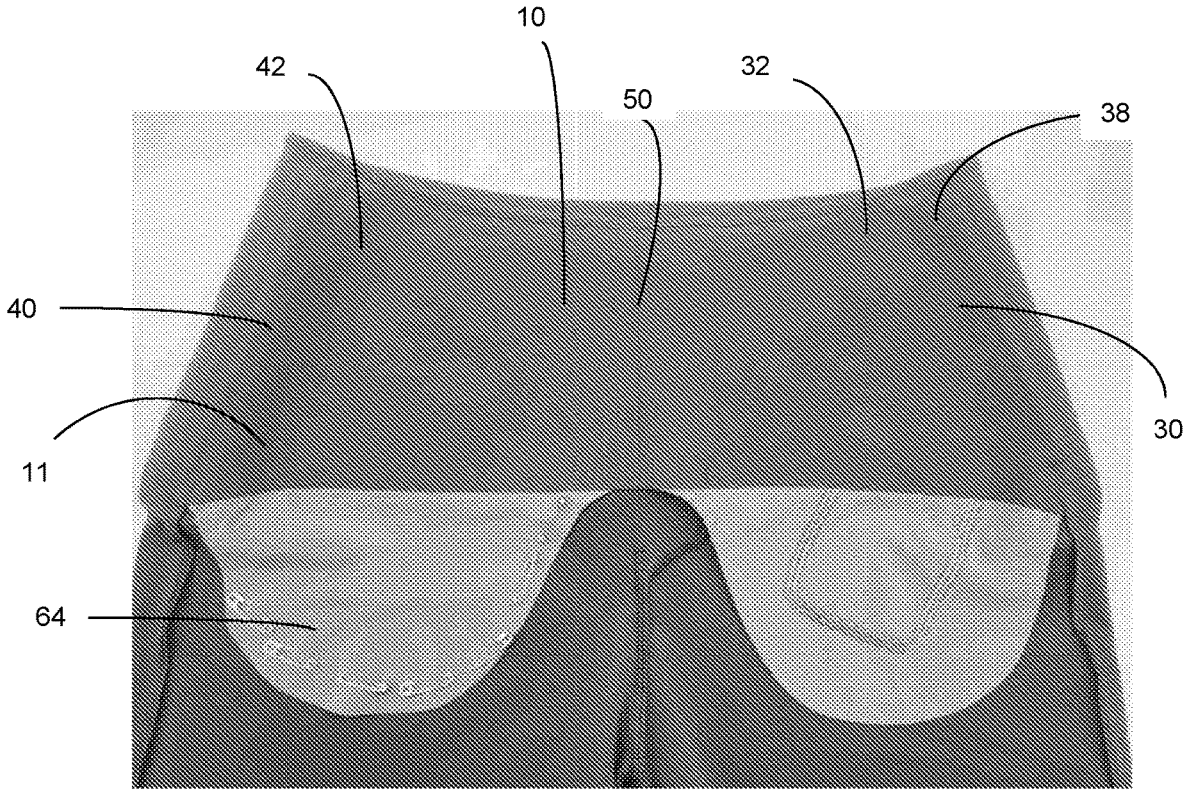
FIG. 7 is a photograph of a front view of an interior of a waistband for a garment in accordance with an embodiment of the invention.
Figure 8:
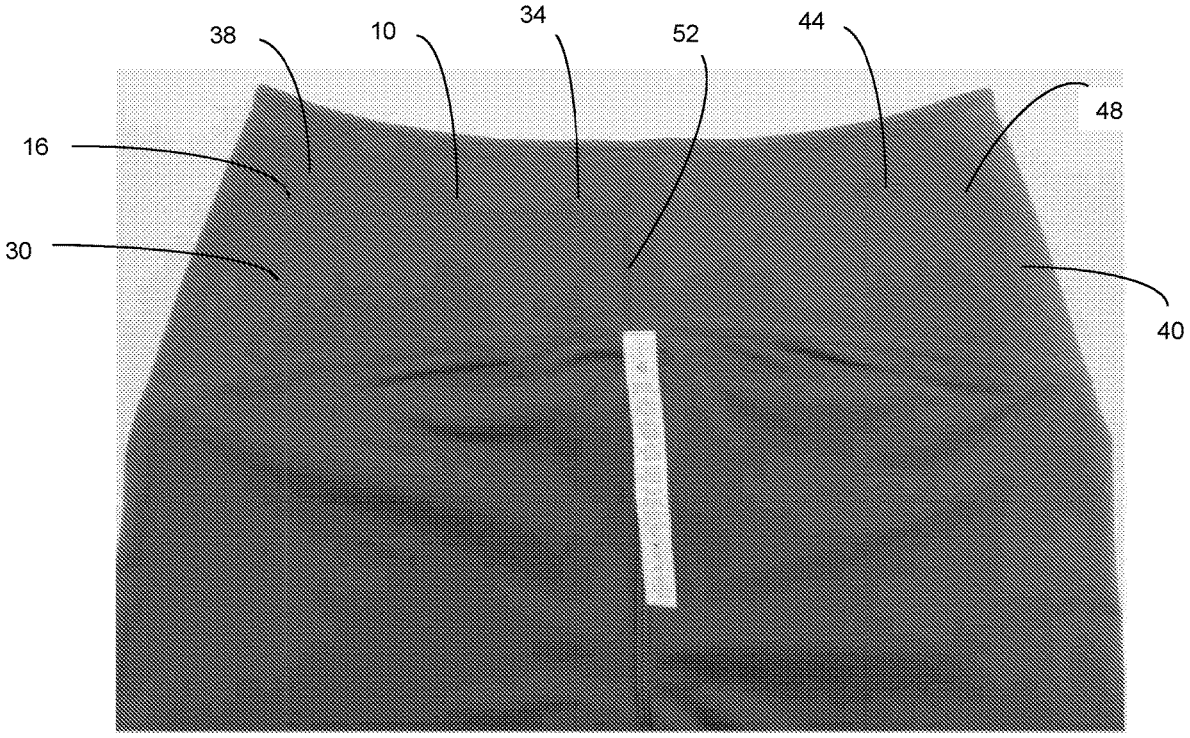
FIG. 8 is a photograph of a back view of an interior of a waistband for a garment in accordance with an embodiment of the invention.
Figure 9:
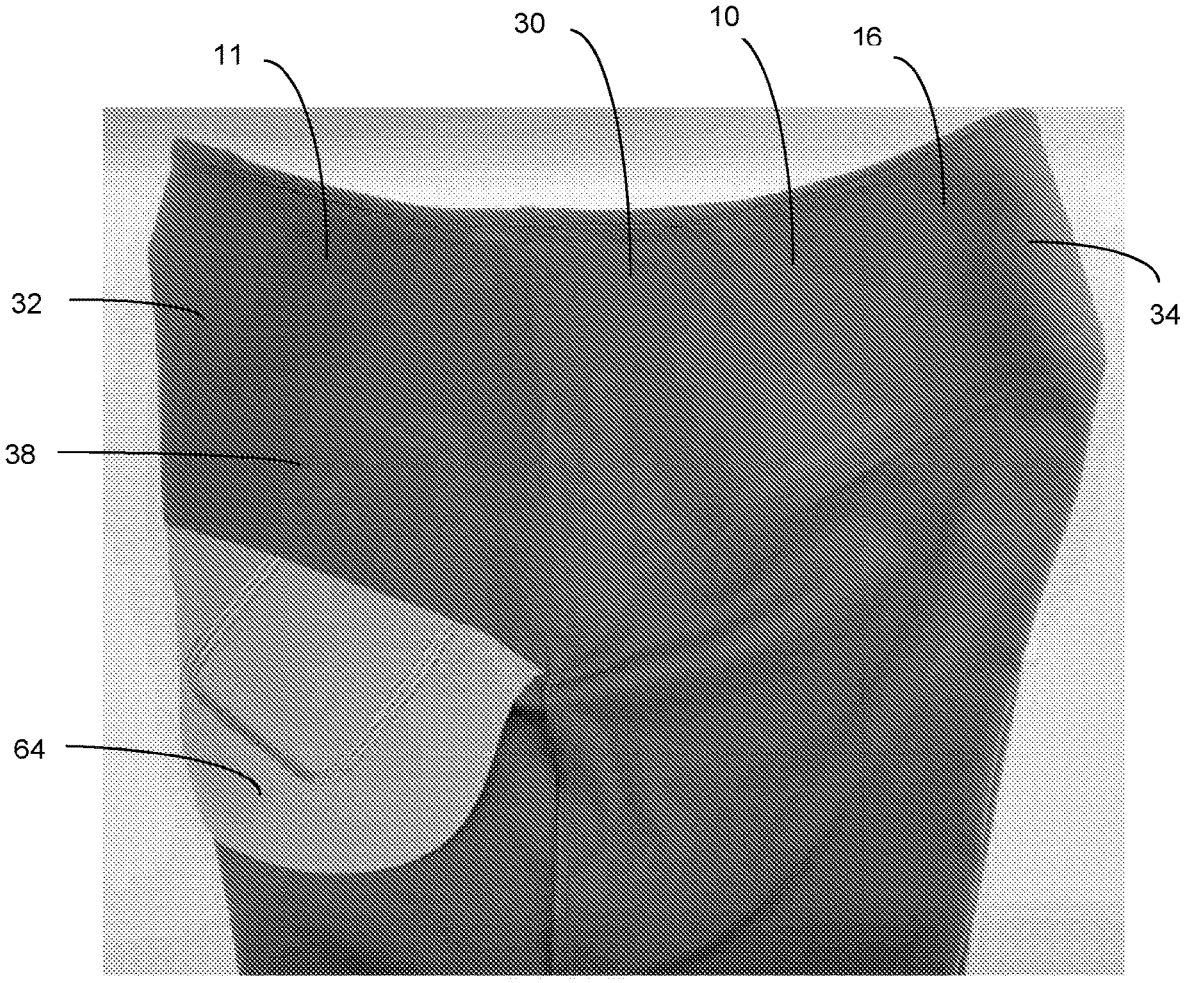
FIG. 9 is a photograph of a side view of an interior of a waistband for a garment in accordance with an embodiment of the invention.

As shown in FIGS. 7 and 8, the waistband 10 also comprises a first inner panel 30 having a first inner panel front side 32, a first inner panel back side 34, a first inner panel inner face (not shown) and a first inner panel outer face 38, and a second inner panel 40 having a second inner panel front side 42, a second inner panel back side 44, a second inner panel inner face (not shown) and a second inner panel outer face 48. The first inner panel 30 extends from a front central line 50 at the front portion 11 to a back central line 52 at the back portion 16 and covers the first side seam 26 (FIG. 9). The second inner panel 40 extends from the front central line 50 at the front portion 11 to the back central line 52 at the back portion 16 and covers the second side seam 28. The first inner panel outer face 38 and the second inner panel outer face 48 form an inside of the waistband 10, which faces the wearer and is in contact with the wearer's body. The inside of the waistband 10 is seamless.

In various embodiments, the first inner panel 30 and the second inner panel 40 are sized and shaped so as to mirror the size and shape of the back portion outer panel 18 and/or the front portion outer panel 12.

In various embodiments, a top edge of the front portion outer panel 12 and a top edge of the back portion outer panel 18 can be flipped over and connected to a top edge of the first inner panel 30 and a top edge of the second inner panel 40, thereby forming a top edge 58 of the waistband 10.

The front portion outer panel 12, the back portion outer panel 18, the first inner panel 30 and the second inner panel 40 may be made of the same or different fabrics. For example, the fabric of the front portion outer panel 12, the back portion outer panel 18, the first inner panel 30 and the second inner panel 40 each may be a blend of nylon and spandex, a blend of nylon and Lycra®, or a blend of nylon and elastane, or of any other suitable natural or synthetic material.

Figure 10:
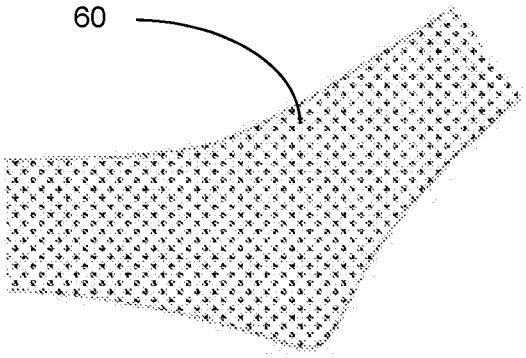
FIG. 10 is plan view of an adhesive panel in accordance with an embodiment of the invention.

The waistband 10 further comprises at least one bonding adhesive panel 60, for example as shown in FIG. 10, for bonding together the back portion outer panel 18 with the first inner panel 30 and the second inner panel 40. Alternatively, the at least one bonding adhesive panel 60 may bond together the front portion outer panel 12 with the first inner panel 30 and the second inner panel 40. In these embodiments, the first inner panel 30 and the second inner panel 40 overlap along the front central line 50 and the back central line 52.

Figure 12:
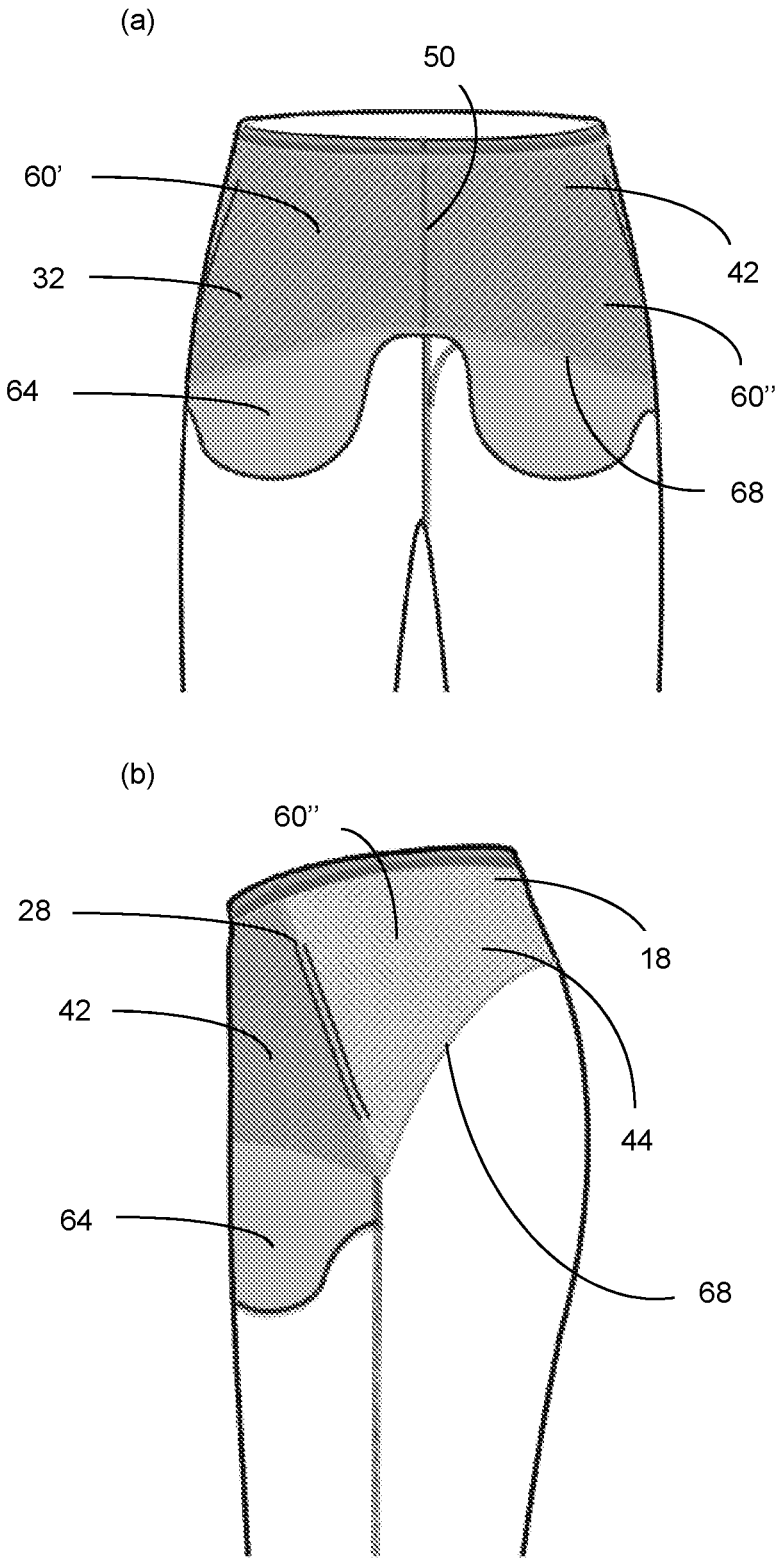
FIG. 12 is (a) a front plan view, (b) a side plan view and (c) a back plan view of a waistband for a garment in accordance with an embodiment of the invention.
Figure 12:
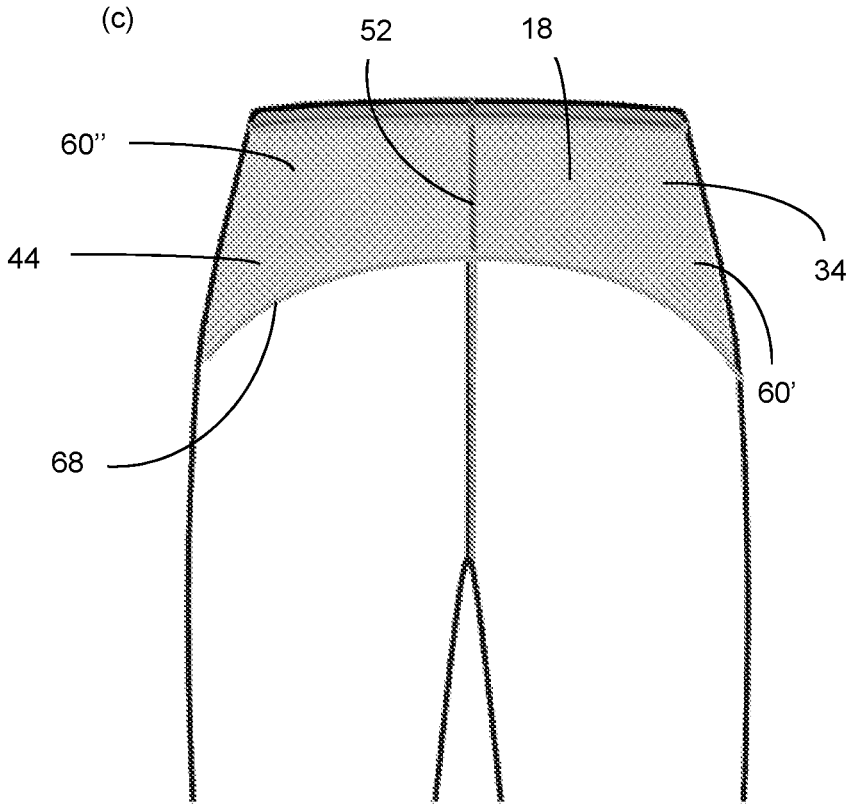

In various embodiments, the at least one bonding adhesive panel 60 is engineered to form an adhesive pattern. For example, the adhesive pattern may be configured to form at least two zones, a first zone having a first stretching value and a second zone having a second stretching value, the second stretching value being different from the first stretching value. In these embodiments, the waistband 10 may have areas, or zones, which fit tighter against the wearer's body as compared to other areas or zones. The at least one bonding adhesive panel 60 may be an adhesive fabric sheet with a number of holes arranged in a desired pattern and coated in a heat-activated adhesive. In various embodiments, the at least one adhesive panel 60 may comprise a solid glue strip 68 (FIG. 12) formed along its edges to stabilize the waistband 10, and to prevent some of the adhesive distributed in the adhesive pattern from leaking out of the adhesive panel 60.

In various embodiments, the waistband 10 may include an elastic band, for example, an elastic trim, sewn along the top edge 58 of the waistband 10 for a snugger fit of the garment against the body of the wearer. For example, a top edge of the front portion outer panel 12 and a top edge of the back portion outer panel 18 can be flipped over and connected to a top edge of the first inner panel 30 and a top edge of the second inner panel 40, thereby wrapping the elastic band and forming the top edge 58 of the waistband 10. In various embodiments, the elastic trim may extend only partially along the circumference of the top edge 58 of the waistband 10. For example, the elastic trim may extend only along the top edge 58 of the front portion 11 of the waistband 10 to prevent roll down of the waistband 10, particularly during exercise, while being omitted from the top edge 58 along the back portion 16 of the waistband 10.

Although the Figures show a pair of pants including the waistband as disclosed herein, the garment may be any other article of clothing such as, for example, leggings, tights, skirts, skorts, dresses or shorts.

Figure 11:
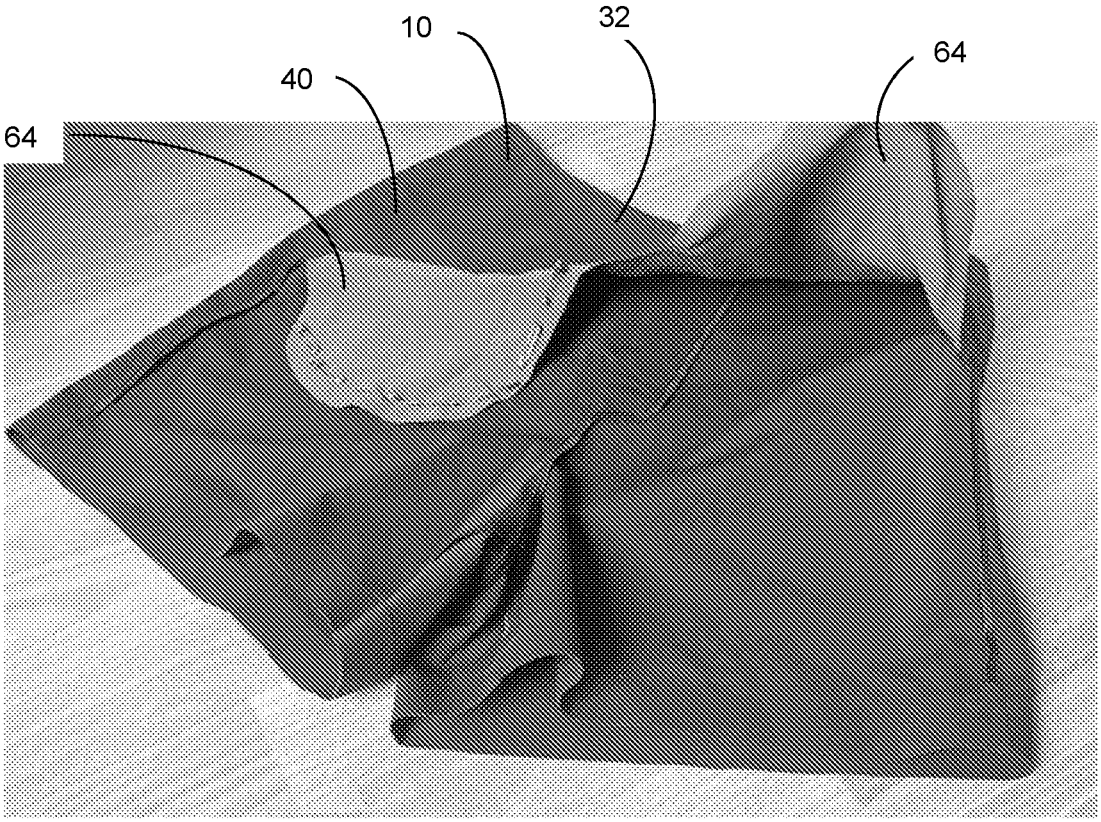
FIG. 11 is a photograph of a front view of an interior of a waistband for a garment in accordance with an embodiment of the invention, where one pocket bag is bonded to a first inner panel inner face of a first inner panel front side, and an additional pocket bag is bonded to a second inner panel inner face of a second inner panel front side.

In various embodiments, the waistband 10 further comprises at least one pocket bag 64 connected to the top edge 58 of the front portion 11. At least a portion of the at least one pocket bag 64 is bonded to the first inner panel front side 32 on the first inner panel inner face, and/or to the second inner panel front side 42 on the second inner panel inner face, such that the at least one picket bag 64 is facing the front portion inner face of the front portion outer panel 12. The at least one pocket bag 64 has an entrance opening 66 to access into the at least one pocket bag 64 and the front portion 11 has a corresponding opening. The entrance opening 66 may also include bartacks at each end to provide reinforcement to the entrance opening 66. In various embodiments, the waistband 10 may comprise two pocket bags, where one pocket bag is bonded to the first inner panel front side 32 and an additional pocket bag is bonded to the second inner panel front side 42, as shown in FIG. 11.

In various embodiments, the at least one pocket bag 64 is bonded only to the first inner panel inner face of the first inner panel front side 32, and/or the second inner panel inner face of the second inner panel front side 42 and is separate from the front portion inner face of the front portion outer panel 12 (FIG. 11), to prevent the at least one pocket bag 64 from being seen on the front portion outer face 15 of the front portion outer panel 12. For example, and as shown in FIGS. 12*a-c*, a first adhesive panel 60' may bond the at least one pocket bag 64 to the first inner panel front side 32 and the first inner panel back side 34 to the back portion outer panel 18, extending from the front central line 50 to the back central line 52 and covering the first side seam 26, and a second adhesive panel 60" may bond the at least one pocket bag 64 to the second inner panel front side 42 and the second inner panel back side 44 to the back portion outer panel 18, extending from the front central line 50 to the back central line 52 and covering the second side seam 28.

In various embodiments, a lower part of the at least one pocket bag 64 is free hanging from a lower edge of the first inner panel 30 and/or the second inner panel 40 as shown in FIGS. 7 and 9. Alternatively, edges of the at least one pocket bag 64 may be bonded to the front panel inner face.

In various embodiments, the at least one pocket bag 64 is connected to one of the first or second side seams, 26 and 28, respectively.

In various embodiments, the at least one pocket bag 64 further comprises a fastener 65, such as a zipper, configured to close and open the entrance opening 66 of the at least one pocket bag 64, as shown in FIGS. 4 and 6. In various embodiments, the entrance opening 66 of the at least one pocket bag 64 and the corresponding opening in the front portion 11 are attached, such that the fastener is configured to close and open both the entrance opening 66 of the at least one pocket bag 64 and the corresponding opening in the front portion 12. Alternatively or in addition, the at least one pocket bag 64 may further comprise a mesh pocket 68 within the at least one pocket bag 64. The mesh pocket 68 may be included on either side of the inner cavity of the at least one pocket bag 64.

In various embodiments, and for aesthetics, the garment incorporating the waistband 10 may also include a faux fly 70 by topstitching on the front portion outer face 15 of the front portion outer panel 12.

While particular elements, embodiments and applications of the present application have been shown and described, it will be understood, that the scope of the application is not limited thereto, since modifications can be made by those skilled in the art without departing from the scope of the present application, particularly in light of the foregoing teachings. Thus, for example, in any method or process disclosed herein, the acts or operations making up the method/process may be performed in any suitable sequence and are not necessarily limited to any particular disclosed sequence. Elements and components can be configured or arranged differently, combined, and/or eliminated in various embodiments. The various features and processes described above may be used independently of one another, or may be combined in various ways. All possible combinations and subcombinations are intended to fall within the scope of this application. Reference throughout this disclosure to "some embodiments," "an embodiment," or the like, means that a particular feature, structure, step, process, or characteristic described in connection with the embodiment is included in at least one embodiment. Thus, appearances of the phrases "in some embodiments," "in an embodiment," or the like, throughout this disclosure are not necessarily all referring to the same embodiment and may refer to one or more of the same or different embodiments. Indeed, the novel methods and systems described herein may be embodied in a variety of other forms; furthermore, various omissions, additions, substitutions, equivalents, rearrangements, and changes in the form of the embodiments described herein may be made without departing from the spirit of the application.

Various aspects and advantages of the embodiments have been described where appropriate. It is to be understood that not necessarily all such aspects or advantages may be achieved in accordance with any particular embodiment. Thus, for example, it should be recognized that the various embodiments may be carried out in a manner that achieves or optimizes one advantage or group of advantages as taught herein without necessarily achieving other aspects or advantages as may be taught or suggested herein.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without operator input or prompting, whether these features, elements and/or steps are included or are to be performed in any particular embodiment. No single feature or group of features is required for or indispensable to any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The example calculations, simulations, results, graphs, values, and parameters of the embodiments described herein are intended to illustrate and not to limit the disclosed embodiments. Other embodiments can be configured and/or operated differently than the illustrative examples described herein.

What is claimed is:

1. A waistband for a garment, comprising:

a front portion for covering at least a portion of an abdomen area of a wearer, the front portion having a front portion outer panel extending from a first side of the front portion to a second side of the front portion, the front portion outer panel having a front portion inner face and a front portion outer face;

a back portion for covering at least a portion of a lower back area of the wearer, the back portion having a back portion outer panel extending from a first side of the back portion to a second side of the back portion, the back portion outer panel having a back portion inner face and a back portion outer face, the first side of the back portion connected to the second side of the front portion forming a first side seam, the second side of the back portion connected to the first side of the front portion forming a second side seam, and the front portion outer face and the back portion outer face forming an outside of the waistband;

a first inner panel having a first inner panel front side, a first inner panel back side, a first inner panel inner face and a first inner panel outer face, the first inner panel extending from a front central line at the front portion to a back central line at the back portion and covering the first side seam;

a second inner panel having a second inner panel front side, a second inner panel back side, a second inner panel inner face and a second inner panel outer face, the second inner panel extending from the front central line at the front portion to the back central line at the back portion and covering the second side seam, the first inner panel outer face and the second inner panel outer face forming an inside of the waistband; and at least one bonding adhesive panel bonding together the back portion outer panel with the first and the second inner panels, wherein the inside of the waistband is seamless.

2. The waistband of claim 1, wherein the at least one bonding adhesive panel further bonds together the front portion outer panel with the first and second inner panels.

3. The waistband of claim 2, wherein the first inner panel front side is bonded to and overlaps the second inner panel front side, and the first inner panel back side is bonded to and overlaps the second inner panel back side.

4. The waistband of claim 1, further comprising at least one pocket bag connected to a top edge of the front portion, at least a portion of the at least one pocket bag being bonded to at least one of the first inner panel inner face and/or the second inner panel inner face such that the at least one pocket bag is facing the front portion inner face of the front portion outer panel, the at least one pocket bag having an entrance opening to access into the packet bag and the front portion having a corresponding opening.

5. The waistband of claim 4, wherein the at least one pocket bag is separate from the outer panel inner face.

6. The waistband of claim 5, wherein a lower part of the at least one pocket bag is free hanging from a lower edge of the first inner panel and/or the second inner panel.

7. The waistband of claim 4, wherein the at least one pocket bag is connected to one of the first or the second side seams.

8. The waistband of claim 4, wherein one pocket bag is bonded to the first inner panel front side and an additional pocket bag is bonded to the second inner panel front side.

9. The waistband of claim 4, further comprising a fastener configured to close and open the entrance opening of the at least one pocket bag.

10. The waistband of claim 1, wherein the at least one bonding adhesive panel is engineered to form an adhesive pattern.

11. The waistband of claim 10, wherein the adhesive pattern is configured to form at least two zones, one zone having a first stretching value and the second zone having a second stretching value, the second stretching value different from the first stretching value.

12. The waistband of claim 1, further comprising an elastic band along a top edge of the waistband.

13. A waistband for a garment, comprising:

a front portion for covering at least a portion of an abdomen area of a wearer, the front portion having a front portion outer panel extending from a first side of the front portion to a second side of the front portion, the front portion outer panel having a front portion inner face and a front portion outer face;

a back portion for covering at least a portion of a lower back area of the wearer, the back portion having a back portion outer panel extending from a first side of the back portion to a second side of the back portion, the back portion outer panel having a back portion inner face and a back portion outer face, the first side of the back portion connected to the second side of the front portion forming a first side seam, the second side of the back portion connected to the first side of the front portion forming a second side seam, and the front portion outer face and the back portion outer face forming an outside of the waistband;

a first inner panel have a first inner panel front side, a first inner panel back side, a first inner panel inner face and a first inner panel outer face;

a second inner panel having a second inner panel front side, a second inner panel back side, a second inner panel inner face and a second inner panel outer face, the first inner panel outer face and the second inner panel outer face forming an inside of the waistband;

at least one pocket bag connected to a top edge of the front portion, at least a portion of the at least one pocket bag being bonded to at least one of the first inner panel inner face and/or the second inner panel inner face such that the at least one pocket bag is facing the front portion inner face of the front portion outer panel, the at least one pocket bag having an entrance opening to access into the pocket bag and the front portion having a corresponding opening, the at least one pocket bag being separate from the outer panel inner face; and at least one bonding adhesive panel to bond the at least one of the first inner panel inner face and/or the second inner panel inner face with the at least one pocket bag and the back portion outer panel with at least one of the first and the second inner panels, wherein the inside of the waistband is seamless.

14. The waistband of claim 13, wherein the first inner panel extends from a front central line at the front portion to a back central line at the back portion and covers the first side seam, and the second inner panel extends from the front central line at the front portion to the back central line at the back portion and covers the second side seam.

15. The waistband of claim 13, wherein a lower part of the at least one pocket bag is free hanging from a lower edge of at least one of the first inner panel and/or the second inner panel.

16. The waistband of claim 13, wherein the at least one pocket bag is connected to one of the first or the second side seams.

17. The waistband of claim 14, wherein one pocket bag is bonded to the first inner panel front side and an additional pocket bag is bonded to the second inner panel front side.

18. The waistband of claim 13, wherein the at least one bonding adhesive panel is engineered to form an adhesive pattern.

19. The waistband of claim 18, wherein the adhesive pattern is configured to form at least two zones, one zone having a first stretching value and the second zone having a second stretching value, the second stretching value different from the first stretching value.

20. A waistband for a garment, comprising:

a front portion for covering at least a portion of an abdomen area of a wearer, the front portion having a front portion outer panel extending from a first side of the front portion to a second side of the front portion, the front portion outer panel having a front portion inner face and a front portion outer face;

a back portion for covering at least a portion of a lower back area of the wearer, the back portion having a back portion outer panel extending from a first side of the back portion to a second side of the back portion, the back portion outer panel having a back portion inner face and a back portion outer face, the first side of the back portion connected to the second side of the front portion forming a first side seam, the second side of the back portion connected to the first side of the front portion forming a second side seam, and the front portion outer face and the back portion outer face forming an outside of the waistband;

a first inner panel having a first inner panel front side, a first inner panel back side, a first inner panel inner face and a first inner panel outer face;

a second inner panel having a second inner panel front side, a second inner panel back side, a second inner panel inner face and a second inner panel outer face, the first inner panel outer face and the second inner panel outer face forming an inside of the waistband; and at least one bonding adhesive panel to bond the at least one of the first inner panel inner face and/or the second inner panel inner face with the at least one of the outer panels, wherein the at least one bonding adhesive panel is engineered to form an adhesive pattern, the adhesive pattern configured to form at least two zones, one zone having a first stretching value and the second zone having a second stretching value, the second stretching value different from the first stretching value, and wherein the inside of the waistband is seamless.

21. The waistband of claim 1, wherein the garment is a pair of pants, a pair of tights, a pair of shorts, a skirt, a skort or a dress.

* * * * *